United States Patent [19]

Yasumoto

[11] Patent Number: 4,525,020

[45] Date of Patent: Jun. 25, 1985

[54] ELECTRICAL CONNECTOR

[75] Inventor: Hiromi Yasumoto, Hitaka, Japan

[73] Assignee: Junkosha Company Ltd., Tokyo, Japan

[21] Appl. No.: 531,747

[22] Filed: Sep. 13, 1983

[30] Foreign Application Priority Data

Sep. 21, 1982 [JP] Japan ..... 57-143139

[51] Int. Cl.[3] ..... H01R 13/39

[52] U.S. Cl. ..... 339/99 R; 339/176 MF

[58] Field of Search ..... 339/97 R, 97 P, 98, 339/99 R, 176 MF

[56] References Cited

U.S. PATENT DOCUMENTS 3,156,514 11/1964 Wing et al. ..... 339/97 P 3,768,067 10/1973 Rault ..... 339/99 R

FOREIGN PATENT DOCUMENTS 2097201 10/1982 United Kingdom ..... 339/99 R

*Primary Examiner*—Joseph H. McGlynn

*Attorney, Agent, or Firm*—Mortenson & Uebler

[57] ABSTRACT

A connector is provided comprising a first housing which holds a number of contacts for the conductors of a strip-line electrical cable, and a second housing which provides contact pressure between the conductors and the contacts at a cable end that is separated into two layers. The connector is suitable for a flat cable in which the conductors are arranged such that narrow signal conductors and wider ground conductors are arranged in pairs on opposite sides of the cable and are alternately arranged transversely across the cable.

3 Claims, 11 Drawing Figures

ELECTRICAL CONNECTOR

BACKGROUND OF THE INVENTION

This device relates to a connector for a flat cable and particularly to a connector to be connected to a strip line cable and the like.

A flat cable is used generally on various types of electronic computers including microcomputers, information processors such as electronic exchangers, word processors and the like, and other types of electronic machinery an apparatus operating to transmit electric signals.

Reliability and electrical stability are required for such a connection. Heretofore, equipment and cables have been connected generally through a connector. For example, the connection is performed by fitting ready access terminals arranged and built into a female or male connector on the cable side to ready access terminals of male and female connectors on machinery and apparatus (hereinafter called simply "apparatus"), terminal pins for printed substrates, etc.

A connector and a flat cable such as, for example, printed cable, ribbon cable or strip line cable have been connected heretofore by breaking through an insulting coating of the cable with the sharp point of a needle or wedge terminal device or a ready access terminal provided with a U-shaped groove for the connector and then connecting with the conductors provided therein. On the other hand, recently, the number of conductors in many flat cables has increased and resulted in high conductor density. There may be cases where the conductors are given in varying sizes for the purpose of improving transmission characteristics. The space between conductors is limited and further a connector mounted on the top side of a cable is detachable, thus resulting in the problem that a satisfactory contact and the connection strength can not be obtained in the conventional manner of connection mentioned above. Consequently, there remains something unsatisfactory in reliability and stability of electrical connection for particular electronic machinery and apparatus.

The device of this invention has been made in view of such defects, unavoidable heretofore, and its object is to provide a connector which is ready for securely connecting with a flat cable and also capable of securing and improving reliability and stability of such electrical connection.

SUMMARY OF THE INVENTION

A connector for a flat cable having alternating pairs of conductors is provided, the connector having an insulating first housing in which a plurality of ready access terminals are fitted to female or male receptacles, an insulating second housing affixed to the first housing, characterized in that the ready access terminals have conductor contact faces which are arranged in two parallel rows, and, in addition, provided on the rear side of the first housing to which the cable is connected are a plurality of conductors of the cable which are exposed and in which the conductors in each pair of conductors is directed away one from the other, the conductors being put into contact with the conductor contact faces of the ready access terminals, the cable conductors being compressed and contacting the conductor faces simultaneously with the affixing of the second housing onto the first housing. A plurality of projections can be provided on the second housing at positions corresponding to the conductor contact faces, and the cable conductors can be compressed and contacting the conductor contact faces through these projections. A plurality of pins can be provided on the second housing at positions corresponding to the conductor contact faces, the pins penetrating the cable conductors or projecting to connect with the conductor contact faces of the ready access terminals. The cable can be provided with a dielectric layer and a plurality of pairs of conductors, each pair comprising a narrow signal conductor and a wider ground conductor which are oriented opposite each other across the dielectric layer, the signal conductors and the ground conductors of the plurality of pairs of conductors being arranged alternately in the transverse direction across the cable.

Figure 1:
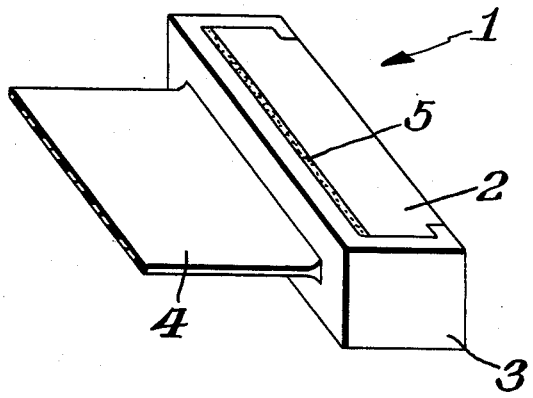
FIG. 1 is a perspective view of a connector according to a preferred embodiment of the device of this invention shown with a strip line cable connected thereto.

DETAILED DESCRIPTION OF THE INVENTION AND PREFERRED EMBODIMENTS WITH REFERENCE TO THE DRAWINGS

A connector is provided comprising a first housing which holds a number of contacts for the conductors of a strip-line electrical cable, and a second housing which provides contact pressure between the conductors and the contacts at a cable end that is separated into two layers. The connector is suitable for a flat cable in which the conductors are arranged such that narrow signal conductors and wider ground conductors are arranged in pairs on opposite sides of the cable and are alternately arranged transversely across the cable.

The gist of the device according to this invention relates to a connector for a flat cable (strip-line cable, for example), wherein the conductors of the flat cable (or strip-line cable) on a connector-connected side are exposed and directed vertically away, one from the other, the conductors being put into contact with conductor contact faces provided on ready access terminals affixed in the connector. The conductors can be fixed thereon through compression or penetration from behind by way of a pin or the like.

The connector and the flat cable (strip-line cable) can be securely connected, and the connection will be kept almost free from defectiveness or disconnection.

As particularized in the embodiments given later and shown in the accompanying drawings, this device relates to a connector 1 for a flat cable (strip-line cable 4, for example) provided with an insulating first housing 2 in which a plurality of ready access terminals 30 or 31 are fitted to female or male connectors, printed substrate and the like are arranged and incorporated, an insulating second housing 3 is fitted onto the first housing 2, which is constituted such that the ready access terminals 30, 31 have conductor contact faces 23, which are arranged in two rows and so provided on a front side of the first housing 2 to which the cable (strip-line cable 4) is connected, a plurality of conductors 32, 33 for the cable (strip-line cable 4) which are exposed and directed vertically away, one from the other, to a flat surface of the cable (strip-line cable 4) and are put into contact with the conductor contact faces 23, the conductors 32, 33 of the cable (strip-line cable 4) being compressed and contacting the conductor contact faces 23 simultaneously with affixing the second housing 3 to the first housing 2.

As described, the cable conductors and the connector terminals are put into contact with each other at the conductor contact faces 23 in a relatively large area, therefore the electrical connection is secured satisfactorily thereby. Moreover, the conductors are exposed and directed vertically away, one from the other, and contacted with the conductor contact faces 23, compressed and secured and thus connected to the flat cable. The cable and the connector will virtually never be disconnected, and the connection strength can be ensured. Reliability and stability of the electrical connection can be secured and improved accordingly.

An embodiment of this device will now be described in detail with reference to the drawings.

FIG. 1 is a perspective view of a connector given in a preferred embodiment of this device when a strip-line cable is connected. In the drawing, numeral 1 denotes the connector, which is constituted of an insulating first housing 2 (connector body) of, for example, synthetic resin or the like, and an insulating second housing 3 fitted thereon. The drawing represents the state wherein the first and second housings are fitted together.

Numeral 4 denotes a strip-line cable connected to the connector 1. An elastic layer 5 consisting of rubber or the like is provided on the second housing 3 and is inserted between the second housing 3 and the first housing 2.

Figure 2A:
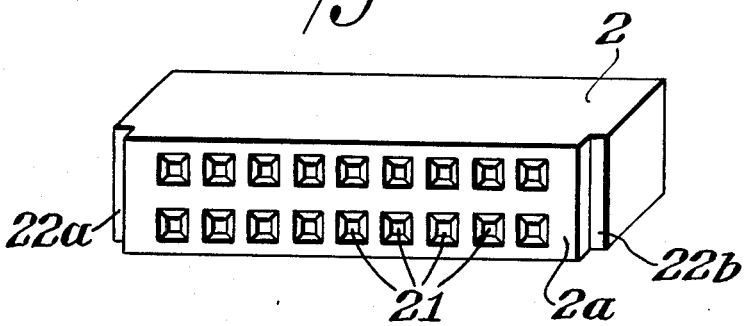
FIG. 2(A) is a perspective front elevation of a first housing of the connector of FIG. 1
Figure 2B:
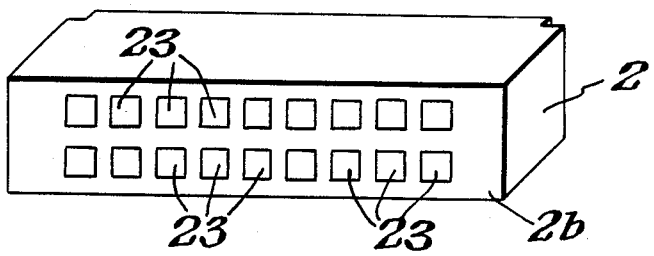
FIG. 2(B) is a perspective rear elevation of said first housing.
Figure 2C:
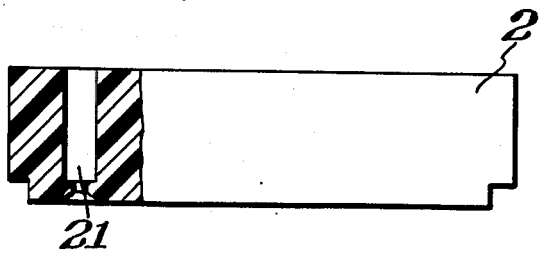
FIG. 2(C) is a top plan view of this first housing, shown partly cut away.

FIG. 2 is a detailed explanatory drawing of the first housing 2 shown in FIG. 1, wherein FIG. 2(A) is a front perspective view, FIG. 2(B) is a rear elevation, FIG. 2(C) is a partially cut away top plan view.

As shown in FIG. 2(A), the first housing 2 is a female connector in a long and narrow box type shape with a multitude of through-holes 21 for insertion of male connectors arranged on the front *2a* in two rows at predetermined intervals, the through-holes 21 penetrating as far as the rear side of the first housing 2 as shown in FIG. 2(C). Then, ready access terminals 30 or 31 shown in FIG. 4 are incorporated into its interior. Further, engaging steps *22a, 22b,* to engage therewith when the second housing 3 is fitted, are provided on both left and right sides of the front *2a* of the first housing.

As shown in FIG. 2(B), conductor contact faces 23 provided on the ready access terminals 30, 31 are exposed and arranged in two rows at predetermined intervals on the rear *2b* corresponding to the through-holes 21 arranged on the front side *2a* of the housing 2.

Figure 3A:
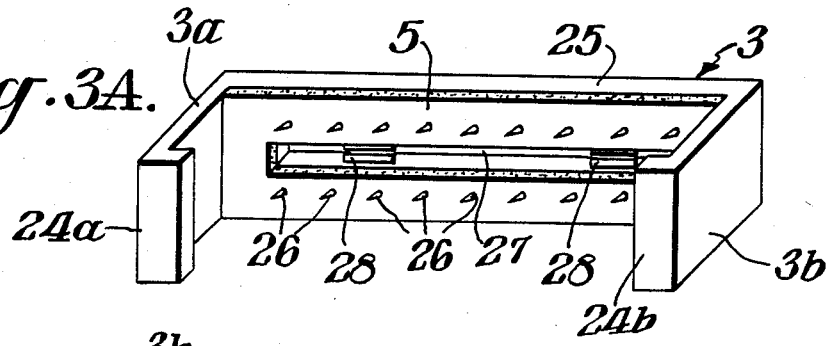
FIG. 3(A) is a perspective front elevation of a second housing of the connector of FIG. 1
Figure 3B:
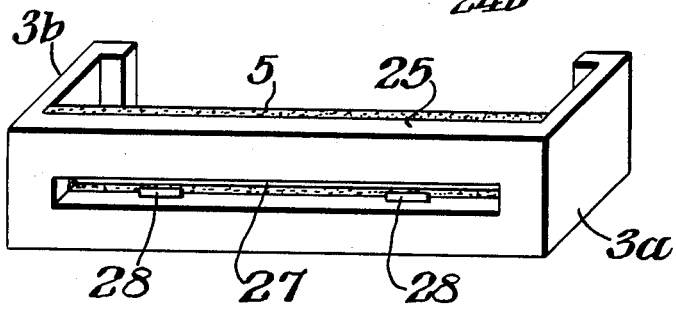
FIG. 3(B) is a perspective rear elevation of said second housing.
Figure 3C:
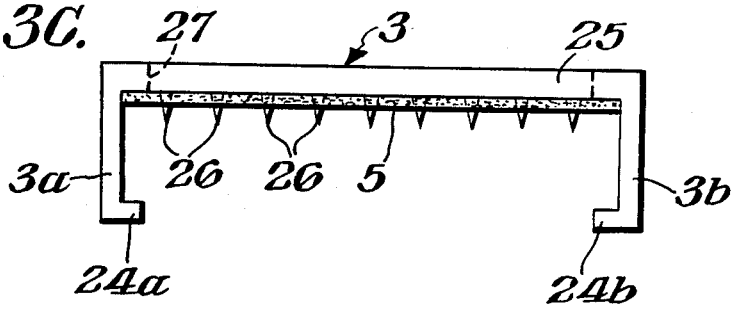
FIG. 3(C) is a top plan view of the second housing.

FIG. 3 is a detailed explanatory drawing of the second housing 3, wherein FIG. 3(A) is a perspective front view, FIG. 3(B) is a rear elevation, and FIG. 3(C) is a top plan view.

As shown in FIG. 3(A), the second housing 3 is C-shaped, long and narrow, and the sides of arms *3a, 3b,* on both sides thereof, are bent inside to form projections *24a, 24b.* The projections *24a, 24b* engage with the engaging steps *22a, 22b* on the left and right sides of the first housing 2. The first housing 2 and the second housing 3 are thus integrated.

On the inside of a central zone 25 of the C-shaped second housing 3, there are arranged a plurality of pins corresponding to the conductor contact faces 23 on the rear side *2b* of the first housing 2. There is further bonded an elastic body layer 5. The projected length comes in the thickness of insulating coat of the strip-line cable 4 plus conductor 32 or 33 or a little longer. The conductors 32, 33 and the ready access terminals 30, 31 and the conductor contact faces 23 are engaged completely thereby.

An opening 27 is provided in the central zone 25 longitudinally thereof, and the strip-line cable 4 is inserted through the opening 27. A projection 28 for preventing the strip-line cable 4 from coming out is provided in two pieces, each vertically at four portions of the central zone 25, along the opening 27.

Figure 4A:
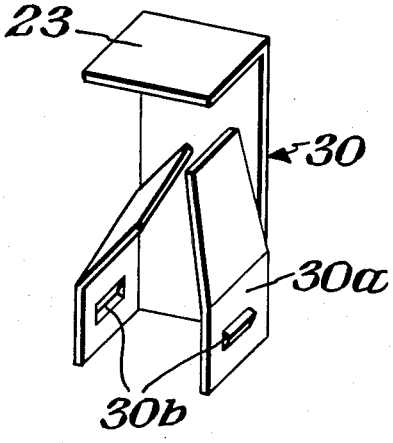
FIG. 4(A) is a perspective view of a ready access terminal used in the connector of FIG. 1
Figure 4B:
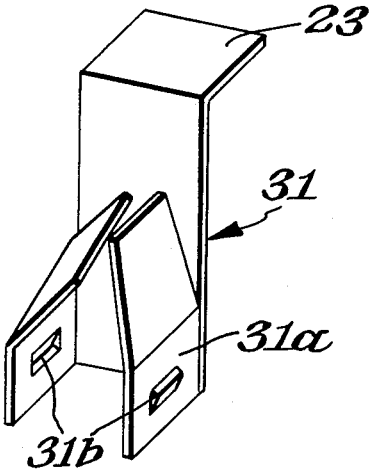
FIG. 4(B) shows a second type of ready access terminal.

FIG. 4(A) is a detailed explanatory drawing of an example of the ready access terminals to be used in the connector 1 given in FIG. 1. FIG. 4(B) is a detailed explanatory drawing of an example of another ready access terminal.

Numerals 30, 31 denote ready access terminals formed into conductors, which are incorporated in the through-holes 21 provided on the first housing 2 illustrated in FIG. 2. Here in the ready access terminal 30, a tip side bent into an L-shape forms the conductor contact faces 23. On the other hand, the ready access terminal 31 represents a case where the L-shaped tip is bent counter to the ready access terminal 30.

A contact part *30a* having a tip bent inside is provided on the ready access terminal 30 and also a projection *30b* is formed thereon. Here, the contact part *30a* comes into contact with a male connecting pin, and the projection *30b* contacts the inside wall of the through-hole 21 to fix the ready access terminal itself. The ready access terminal 31 is constituted very similarly to the ready access terminal 30 and also provided with a contact part *31a* and a projection *31b.*

A connected state of the strip-line cable 4 and the connector 1 will be described next.

Figure 5:
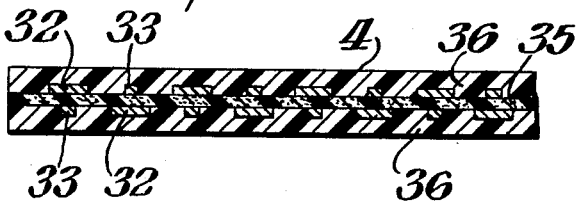
FIG. 5 is a cross-sectional view of a strip line cable for which the connector of this invention is particularly suitable.
Figure 6:
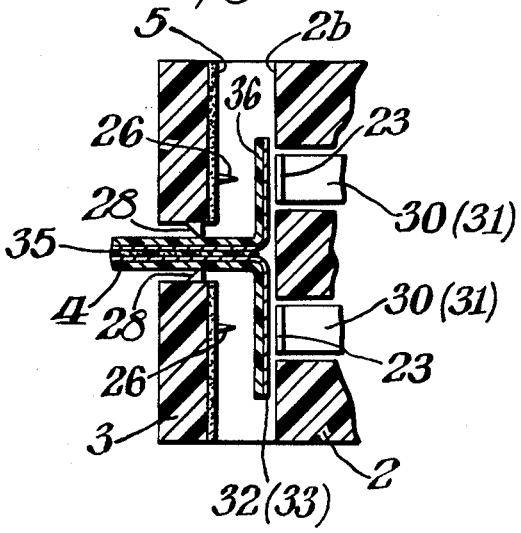
FIG. 6 is a cross-sectional view showing the connector of this invention connected to a strip line cable such as the one depicted in FIG. 5.

FIG. 5 is a sectional view of the strip-line cable 4 shown in FIG. 2, and FIG. 6 is a sectional view representing a connected state of the strip line cable 4 and the connector 1.

In FIG. 5, numeral 32 denotes a grounding conductor and 33 denotes a signal conductor. The strip-line cable 4 in this embodiment is constituted of a dielectric layer 35, a plurality of ground conductors 32 and signal conductors 33 disposed vertically across the dielectric layer 35, and an insulation layer 36 disposed vertically outside to cover them.

The signal conductor 33 and the wider ground conductor 32 opposite thereto across the dielectric layer 35, form a conductor pair. The plurality of conductor pairs have the signal conductor 33 and the ground conductor 32 arranged alternately along the transverse direction of the strip-line cable 4.

Such strip-line cable 4 is first inserted through the opening 27 against the projections 28 of the opening 27 of the second housing 3. Then, it is separated into two halves vertically across the dielectric layer 35. A conductor part (signal conductor 33, ground conductor 32) of the strip-line cable 4 is thus exposed and then put into contact with the conductor contact faces 23 of the ready access terminals 30 or 31. As shown in FIG. 6, the extra portion of the dielectric layer 35 is cut and removed.

The second housing 3 is pressed onto the insulation layer 36 thereafter. The pin 26 thus breaks the insulation layer 36 to press down the conductor part (signal conductor 33, ground conductor 32) from behind. In this case, the elastic body layer 5 also presses down the insulation layer 36. The conductor part of the strip-line cable 4 is thus fixed onto the connector 1 to provide a secure connection.

The connector 1 has the conductor contact faces 23 provided on the rear side 2*b*. Therefore the strip-line cable 4 is capable of contacting with the conductor contact faces 23 in a wide area. Further, the conductor contact faces are arranged in two rows vertically to coincide with the array of the ready access terminals fitted on pins of female or male connectors, printed substrates, etc. Therefore, the strip-line cable 4 has conductors of the connector arranged in two stages vertically likewise and pressed down by the second housing 3 from behind. The conductor part (signal conductor 33, ground conductor 32) of the strip-line cable and the conductor faces 23 are hard to separate. In addition, because the cable 1 is pressed down by the pin 26, it will virtually never be disconnected. Contact with the ready access terminals 30, 31 is secured, consequently.

The embodiment described in detail as above refers to the connection between the strip-line cable and the connector. However, the connection is not necessarily limited to strip line cables only, and it goes without saying that flat cables such as various types of ribbon cable and printed circuit cable can be employed generally for this application. In such cables, the conductors may be divided vertically every other piece to connection.

Shape and type, male or female, of the connector are not necessarily limited to those of the embodiments shown, which applies likewise to shape of the ready access terminals. Furthermore, the conductor contact faces can be provided separately unlike that of the embodiment which is formed integrally with the ready access terminals. In that case, the conductor contact faces will function virtually perfectly with the ready access terminals.

The pins 26 reach the conductor contact faces of the ready access terminals 30, 31 through the insulation layer 36 and the conductor parts 32, 33 of the cable and thus complete a conductive connection. However, it is not necessary to persist in such shape as will penetrate the outside insulation layer of the cable, and something like a projection to hold down the cable from behind will be acceptable. Both the elastic body layer and projection are provided in the embodiment. However, no inconvenience will be involved in providing either elastic body layer or projections alternatively. Moreover, the cable can be kept from separating from the connector by pressing down the cable directly on the second housing without providing either of them.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A connector for a flat cable having alternating pairs of conductors, the connector having an insulating first housing in which a plurality of ready access terminals are fitted to female or male receptacles, an insulating second housing affixed to said first housing, characterized in that said ready access terminals have conductor contact faces which are arranged in two parallel rows, and, in addition, provided on the rear side of said first housing to which said cable is connected are a plurality of conductors of said cable which are exposed and in which the conductors in each pair of conductors are directed away one from the other, the conductors being put into contact with the conductor contact faces of said ready access terminals, said cable conductors being compressed and contacting said conductor faces simultaneously with the affixing of said second housing onto said first housing, and wherein a plurality of pins are provided on said second housing at positions corresponding to said conductor contact faces, and said cable conductors are compressed and contacting said conductor contact faces through said pins.

2. The connector of claim 1, wherein a plurality of pins are provided on said second housing at positions corresponding to the conductor contact faces, the pins penetrating the cable conductors or projecting to connect with the conductor contact faces of ready access terminals.

3. The connector as defined in any one of claims 1 or 2, wherein said cable is provided with a dielectric layer and a plurality of pairs of conductors, each pair comprising a narrow signal conductor and a wider ground conductor which are oriented opposite each other across said dielectric layer, said signal conductor and said ground conductor of the plurality of pairs of conductors being arranged alternately in the transverse direction across said cable.

* * * * *